US005477616A

United States Patent [19]

Williams et al.

[11] Patent Number: 5,477,616

[45] Date of Patent: Dec. 26, 1995

[54] COATED KNIFE BLADES

[75] Inventors: David M. Williams; Jess Cawley, both of Sheffield, England

[73] Assignee: McPherson's Limited, Melbourne, Australia

[21] Appl. No.: 52,642

[22] Filed: Apr. 23, 1993

[30] Foreign Application Priority Data

Apr. 24, 1992 [GB] United Kingdom ..... 9208952

[51] Int. Cl.[6] ..... B21K 1/02

[52] U.S. Cl. ..... 30/350; 76/104.1

[58] Field of Search ..... 30/346, 346.53, 30/346.54, 350; 76/101.1, 104.1, DIG. 8

[56] References Cited

U.S. PATENT DOCUMENTS 3,193,926 7/1965 Honiss ..... 30/350

3,850,053 11/1974 Bovenkerk ..... 76/101.1

*Primary Examiner*—Douglas D. Watts

*Attorney, Agent, or Firm*—Trexler, Bushnell, Giangiorgi & Blackstone, Ltd.

[57] ABSTRACT

The invention relates to knife blades and their methods of production. Whilst it has long been known that the surface hardness and wear resistant properties of metal objects can be enhanced by a hard surface provided on them, the effective employment of this in relation to knife blades has proved difficult to achieve. The object of the invention is to provide a knife blade with a cutting edge of a harder material than the body of the blade, and the objective is met by a construction comprising a v-shaped cutting edge formed on a blank and such that the cutting tip lies substantially centrally of the width of the blank characterised in that one side face of the v-shaped cutting edge is provided with a coating of a material harder than the material of the blank, the actual cutting edge being formed wholly of the harder material, and the coating having a columnar crystal structure that extends away from the surface of the blank and to the outer face of the coating.

10 Claims, 2 Drawing Sheets

COATED KNIFE BLADES

This invention relates to knife blades and to a method of their production.

It has long been known that the surface hardness and wear resistant properties of metal objects can be enhanced by the provision of a hard surface on the metal objects. Thus it is known to generate a carbide and/or nitride enriched or transformed surface, by an appropriate heat treatment, and also known to provide a hard surface coating such as by carburising or nitriding, chemical or physical vapour deposition, electroplating, plasma arc spraying, and other equivalent processes.

When considering a knife blade, providing a hard surface particularly at the cutting edge, it is difficult to put into practice by either of the general techniques outlined above, as a consequence of the very thin sections of blank ordinarily employed in knife blade construction, and the acute angle to be found at the cutting tip. To take a finished enriched or transformed hard surface layer, there is the inevitable depletion of carbon from the body of the blade, leaving a blade of insufficient strength. With surface coatings and with a finished blade the relatively small included angle formed at the cutting edge is such that there is an inevitable build-up of coating material at the actual cutting tip and which has a major adverse effect on the sharpness of the blade.

Attempts have been made hitherto to apply a hardened surface to a knife blade such as by a diffusion heat treatment and by vapour deposition of carbides or nitrides. In one known form of construction there has been the treatment of a tapered blank followed by a single wetting or grinding to form a chisel cutting edge and to put the cutting edge in line with one side face of the blank. When subjected to recognised edge testing procedures, such knives have demonstrated no significant improvement in their cutting characteristics in comparison with untreated blades of the same configuration.

The object of the present invention is to provide a knife blade with a cutting edge of a harder material than the body of the blade, and a method of producing knife blades with such harder edges and which display a major improvement in cutting performance in comparison with blades known hitherto.

According to the present invention, a knife blade comprises a v-shaped cutting edge formed on a blank and such that the cutting tip lies substantially centrally of the width of the blank, one side face of the v-shaped cutting edge being provided with a coating of a material harder than the material of the blank, the actual cutting edge being formed wholly of the harder material, the coating having a columnar crystal structure that extends away from the surface of the blank and to the outer face of the coating.

According to a further feature of the invention, a knife blade comprises a v-shaped cutting edge formed on a blank and such that the cutting tip lies substantially centrally of the width of the blank, one side face of the v-shaped cutting edge being provided with a coating of a carbo-nitride, the actual cutting edge being formed wholly of the carbo-nitride material, and the carbo-nitride material displaying a columnar crystal structure that extends away from the surface of the blank and to the outer face of the carbo-nitride coating.

To ensure the production of the required columnar crystal structure within the coating, it is preferred that during the application of the coating, the coating process is controlled to prevent the temperature of the blank exceeding its tempering temperature, with the additional advantage that there is avoided the negating of the temper of the body material.

Thus, the temperature of the blank should be held below 480° C. and preferably below 400° C.

Preferably, the carbo-nitride material is titanium carbo-nitride or chromium carbo-nitride. The coating may be applied by thermal evaporation physical vapour deposition either in the form of electron beam physical vapour deposition, or of arc physical vapour deposition with the arc either random or steered. Equally possible is the employment of sputter physical vapour deposition either in the form of magnetron sputtering or arc bond sputtering.

All of these physical vapour deposition techniques use reactive gas control which allows a plasma generated in a vacuum chamber in which the blade is located to combine with nitrogen and carbon-carrying gases and to result in the deposition of a metallic nitride and/or metallic carbo-nitride coating on the substrate formed by the blade.

The employment of chemical vapour deposition to provide a metallic ceramic coating may also be possible.

To ensure that the whole of the cutting tip is formed by the applied coating, it is preferred to grind a first face of a v-shaped cutting edge and to apply the coating material to the blank, and followed by the grinding of the second face of the v-shaped cutting edge. Preferably, the side faces of a partly-ground blank are masked to limit the application of the coating to the first ground face.

As a consequence of creating a coating of a columnar crystal structure to one side of the v-shaped cutting edge, whilst on the one hand there is the provision of body material directly behind the cutting tip formed wholly from the coating material, and as a consequence of which considerable support is provided to the otherwise somewhat brittle coating material, there is on the other hand the provision of an uncoated second face to the v-shaped cutting edge. Therefore, during normal usage of the knife blade, it displays a considerable initial sharpness directly resulting from the whole of the cutting tip being formed from hard material and there is wear on the uncoated face which whilst to a degree not readily perceptible to the eye, is sufficient to weaken the body material immediately behind the cutting tip. The fact that the coating material is of a columnar crystal structure, has the result that a series of fault lines are provided through the depth of the coating at the interface between adjacent columnar crystals. This, plus the minute degree of wear on the uncoated surface of the cutting edge during use, causes the exposure of such a fault line and the breaking away from the coating of the outermost columnar crystals. Consequently, and during use of the knife, there is the effective regeneration of the cutting edge, with the effect of that in providing not only a considerable initial sharpness but also the maintenance of the cutting edge to a degree that cannot be matched by any knife known hitherto.

Preferably, the material of the blank is a martensitic stainless steel having a carbon content in the range 0.16% to 0.36%, and further preferably has a chromium content of 12% to 14%. Whilst the surface finish of the blank is not critical, it is highly desirable that it is not highly polished and not overly rough. It is therefore preferred that the surface finish on the blank is in the range 0.1 RA to 2.0 RA, with a preferred hardness in the range 46–54 HRC.

For optimum performance characteristics, the depth of the thickness of the applied hard surface coating should be in the range 2.0 μm to 20 μm, and preferably in the range 8 μm to 15 μm.

Whilst of necessity the cutting edge formed on the blank must be a discrete vee cutting edge with the cutting tip lying substantially central of the blank width, the blank can be a parallel-sided blank or can of itself be tapered to one or to both sides.

The cutting edge itself can be formed by flat grinding or plunge grinding of a first face prior to the effecting of the coating and flat or plunge grinding the second face subsequent to the coating. However, other edge forms can be provided with enhanced performance within the present invention. Thus, the two grinding stages can be such as to provide a hollow ground edge. Equally the edge form can be the first grinding of a face of the vee shaped cutting edge with serrations, scallops, or combinations therefore and the flat or plunge grinding of the second face.

Particularly with a plunge or flat ground edge form, it is preferred that the vee shaped cutting edge has an included angle of 14° to 30°. Further preferably the included angle lies between 16° and 22° and still further preferably the included angle lies between 18° and 20°.

In the form of construction where a first face of the vee shaped cutting edge is ground with serrations, it is preferred to provide between 25 and 50 serrations per inch and further preferably to provide 40 serrations per inch. Desirably, the included angle of the serrations lies between 80° and 100°, preferably 90°. In the form of construction where a first face of the vee shaped cutting edge is ground with scallops, the scallops may have a radius in the range 0.1", preferably 0.16" to 0.75" and may have a pitch in the range 1.0 to 10 and preferably 1 to 5 T.P.I.

An essential advantage of the invention in addition to the provision of considerably enhanced performance characteristics in comparison with conventional blades lies in the fact that no subsequent process beyond the second grinding stage is required save perhaps for a final polishing.

The invention will now be further discussed with reference to the accompanying drawings, in which.

The three knives were subjected to the same recognised edge test where a block of 150 cards, each 0.3 mm thick, were provided in a holder, a knife blade held in position with its edge resting on the lowermost card and the card holder provided with a static load of 30N and the knife reciprocated at a constant rate of 50 mm/sec over a 50 mm stroke length. The number of strokes taken to cut through a block of cards was noted and the block replaced when completely cut through, the test being treated as ended when more than 30 strokes were required to cut through a block of cards.

Figure 1:
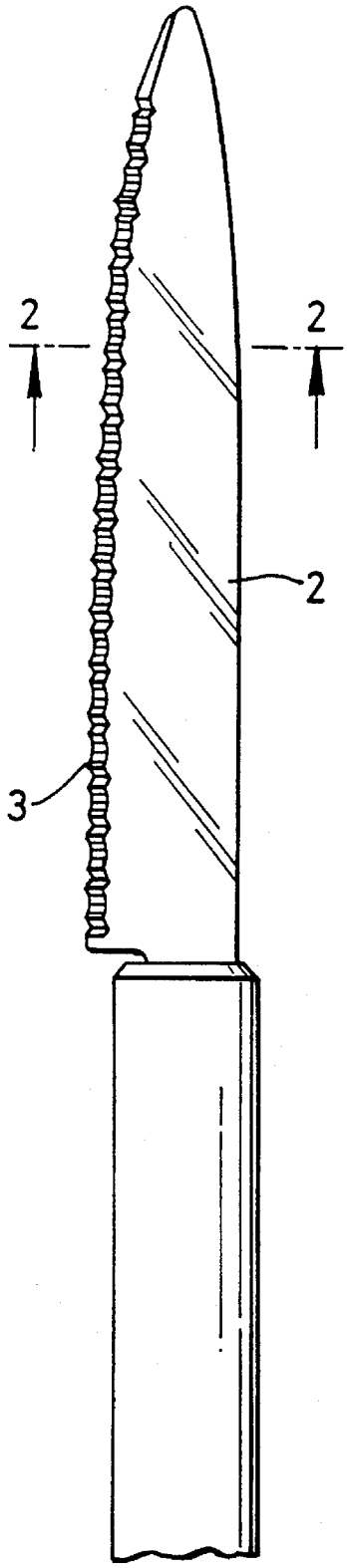
FIG. 1 is a side elevation of a knife blade in accordance with the invention.
Figure 2:
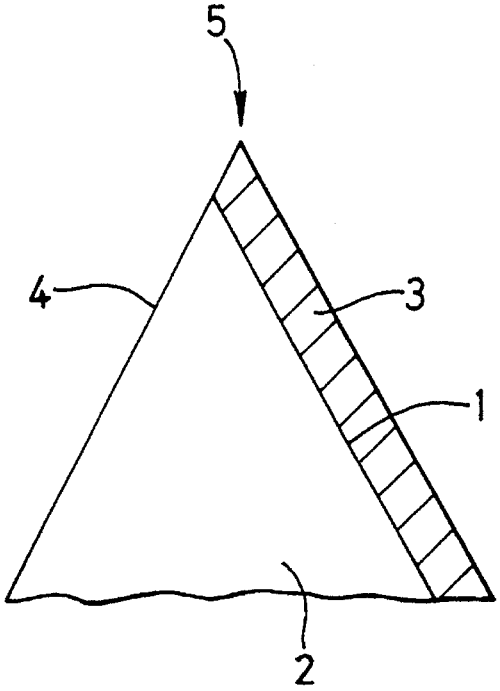
FIG. 2 is a section on the line 2—2 of FIG. 1.

Of the three knives, Blade A of FIG. 1 was a utility knife constructed in accordance with British Patent No. 2108887, Blade B was a utility knife constructed in accordance with European Patent No. 0220362, and Blade C was a utility knife constructed in accordance with the invention. Each of Blades A, B, and C, were formed from a parallel-sided blank with a substantially centrally located v-shaped cutting edge, plane ground to one side and provided with serrations and scallops to the other side. The blade of the invention, Blade C, was prepared by first grinding one side 1 of the generally v-shaped edge of a knife blade 2, following which the coating 3 of the invention was applied, and followed by the grinding of the second face 4 of the cutting edge to form at the cutting tip 5 a cutting edge formed wholly of the coating material. The coating was formed by a magnetron sputtering technique as is of itself known, but with the temperature within the chamber held at below the tempering temperature of the material of the blade blank i.e. at approximately 350° C. and hence below the conventional temperatures at which magnetron sputtering is effected for its other uses, to guarantee the creation of a columnar crystal structure in the material coated on the blade edge. The reactive gases were carbon carrying acetylene and nitrogen and the target in the chamber was titanium and whereby a titanium carbo-nitride coating was formed on the blade edge.

The purpose for the selection of Blades A and B respectively made in accordance with British Patent No. 2108887 and European Patent No. 0220362, is that they constitute edge constructions with better edge retention characteristics than other edge constructions known in the art.

Figure 3:
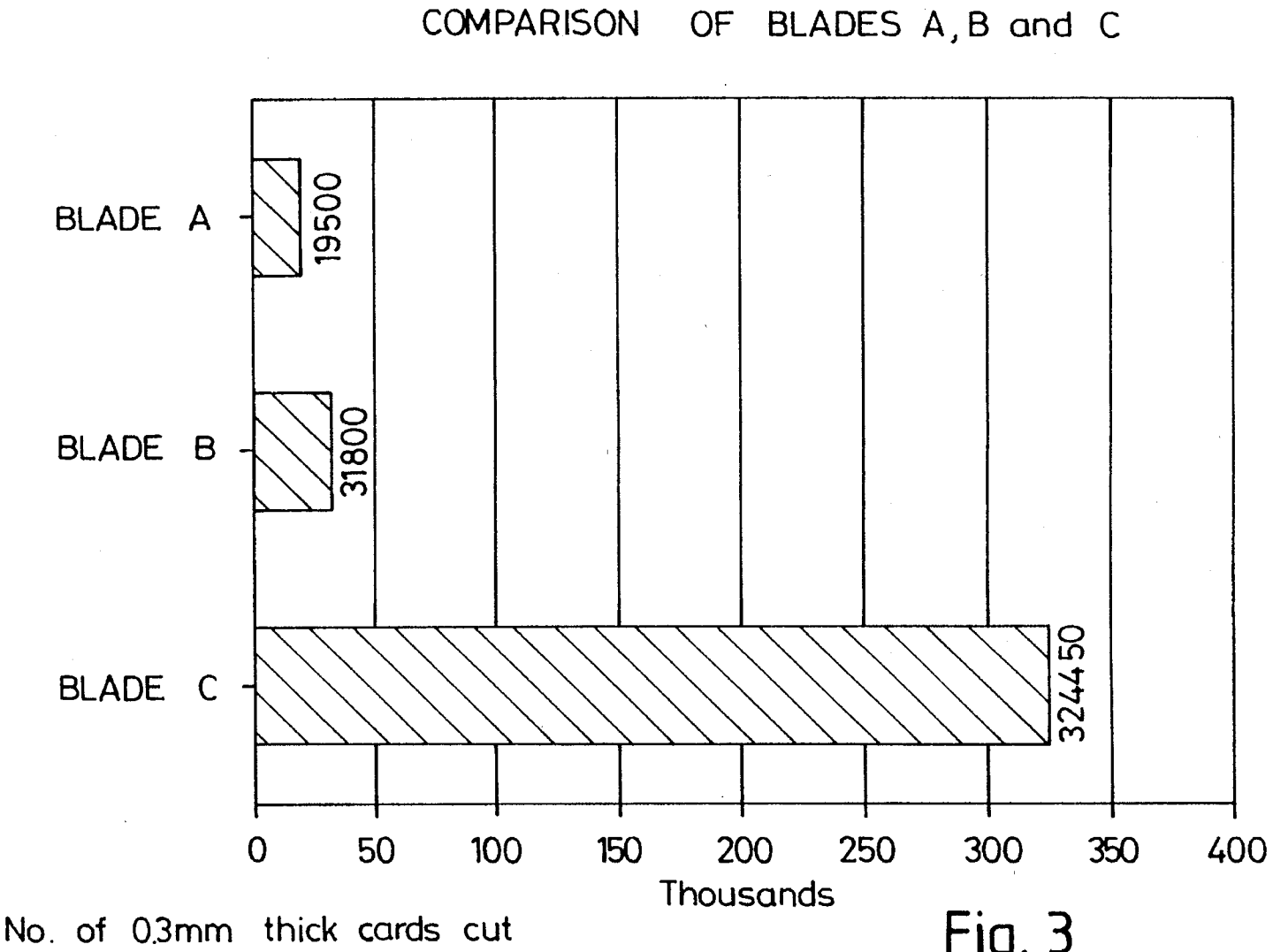
FIG. 3 is a block diagram representation of the cutting performances of three knives subjected to the identical test as is detailed below.

As is shown by FIG. 3, Blade A cut a total of 19,500 cards up to the suspension of the test, Blade B cut a total of 31,800 cards and Blade C, in accordance with the invention, a total of 324,450 cards, evidencing the provision of edge retention characteristics by the invention massively improved over the edge retention characteristics of the blades of the prior art.

We claim:

1. A knife blade comprising a v-shaped curing edge formed on a blank and such that the cutting tip lies substantially centrally of the width of the blank characterized in that one side face of the v-shaped cutting edge is provided with a coating of a material harder than the material of the blank, the actual cutting edge being formed wholly of the harder material, the coating having a columnar crystal structure that extends away from the surface of the blank and to the outer face of the coating and the material of the blank is a martensitic stainless steel having a carbon content in the range 0.16% to 0.36%.

2. A knife blade comprising a v-shaped cutting edge formed on a blank and such that the cutting tip lies substantially centrally of the width of the blank characterised in that one side face of the v-shaped cutting edge is provided with a coating of a carbo-nitride, the actual cutting edge being formed wholly of the carbo-nitride material and the carbo-nitride material displaying a columnar crystal structure that extends away from the surface of the blank and to the outer face of the carbo-nitride coating.

3. A knife blade as in claim 2, characterised in that the carbo-nitride material is titanium carbo-nitride.

4. A knife blade as in claim 2, characterised in that the carbo-nitride material is chromium carbo-nitride.

5. A knife blade as in claim 2 or claim 3 characterized in that the material of the blank is a martensitic stainless steel having a carbon content in the range 0.16% to 0.36%.

6. A knife blade as in claim 5, characterised in that the material of the blank has a chromium content of 12% to 14%.

7. A knife blade as in claim 5, characterized in that the surface finish on the blank is in the range 0.1RA to 2.0RA.

8. A knife blade as in any one of claims 1 to 3, characterised in that the depth of the thickness of the applied coating of a harder material is in the range 2.0 μm to 20μm.

9. A knife blade as in claim 8, characterised in that the depth of the thickness of the applied coating is in the range 8 μm to 15 μm.

10. A knife blade as in claim 1, wherein the material of the blank has a chromium content of 12% to 14%.

* * * * *